US009399154B2

(12) United States Patent
Zwart

(10) Patent No.: US 9,399,154 B2
(45) Date of Patent: Jul. 26, 2016

(54) GOLF BALL CARRYING AND ALIGNMENT TOOL

(71) Applicant: Sandgroup International Ltd., Hong Kong (CN)

(72) Inventor: Michel Zwart, Haarlem (NL)

(73) Assignee: Sandgroup International Ltd., Kwai Chung (HK)

( * ) Notice: Subject to any disclaimer, the term of this patent is extended or adjusted under 35 U.S.C. 154(b) by 103 days.

(21) Appl. No.: 14/565,949

(22) Filed: Dec. 10, 2014

(65) Prior Publication Data

US 2016/0166889 A1 Jun. 16, 2016

(51) Int. Cl.

| | |
|---|---|
| ***A63B 69/36*** | (2006.01) |
| ***A63B 45/02*** | (2006.01) |
| ***A45C 11/36*** | (2006.01) |
| ***A45C 13/00*** | (2006.01) |
| ***A45C 13/02*** | (2006.01) |
| ***B65D 25/22*** | (2006.01) |
| ***A63B 47/00*** | (2006.01) |

(52) U.S. Cl.

CPC ..... *A63B 45/02* (2013.01); *A45C 11/36* (2013.01); *A45C 13/005* (2013.01); *A45C 13/02* (2013.01); *A63B 47/00* (2013.01); *B65D 25/22* (2013.01)

(58) Field of Classification Search

CPC ..... A63B 45/02; A63B 47/001; A63B 47/00; A45F 5/00; A45F 5/021; Y10S 224/918

See application file for complete search history.

(56) References Cited

U.S. PATENT DOCUMENTS

| | | | | |
|---|---|---|---|---|
| 1,871,812 | A * | 8/1932 | Lyon | A63B 45/02 101/38.1 |
| 6,216,587 | B1 * | 4/2001 | Foley | A63B 45/02 101/35 |
| 8,118,691 | B1 * | 2/2012 | Jung | A63B 45/02 101/127 |
| 2001/0053721 | A1 * | 12/2001 | Tyke | A63B 43/008 473/257 |
| 2009/0277940 | A1 * | 11/2009 | Cook | A63B 45/02 224/576 |

* cited by examiner

*Primary Examiner* — Adam Waggenspack

(74) *Attorney, Agent, or Firm* — Jason T. Daniel, Esq.; Daniel Law Offices, P.A.

(57) ABSTRACT

A golf ball carrying and alignment tool includes an elongated member having a generally circular aperture disposed along the bottom end. A slit traverses the bottom end and engages the aperture. A lid is hingedly secured above the aperture, a clip is disposed along the top end of the main body, and a writing instrument is removably secured within a channel on the main body.

6 Claims, 6 Drawing Sheets

GOLF BALL CARRYING AND ALIGNMENT TOOL

TECHNICAL FIELD

The present invention relates generally to sporting goods, and more particularly to a device for use in the game of golf.

BACKGROUND

The statements in this section merely provide background information related to the present disclosure and may not constitute prior art.

The game of golf is one of the most widely played sports activities in the world. Golf courses typically include either 9 or 18 holes, each comprising a teeing ground, a fairway area, one or more roughs (and other hazards), as well as a putting green where the hole is located.

Once the golf ball is on the green, a specialized golf club called a putter is used by the golfer. Putters are designed to strike golf balls in a manner that keeps the ball on the ground, thereby ensuring greater accuracy. As such, it is not uncommon for putters to include sight lines, dots or other such markings which can assist the golfer in aligning the putter with the golf ball and the hole. Moreover, there are commercially available stencils which can be further used to create additional markings on the golf balls themselves, however storage of these devices is inconvenient, and their use also requires that the golfer find a permanent marker, which are not readily available on a golf course.

In either instance, once the ball has been successfully putted, the user will then typically place the ball into their pocket, golf bag or other enclosed area until they reach the next hole. During this time, the golf ball can become lost, thus requiring the golfer to switch golf balls mid-round.

Accordingly, it would be beneficial to provide a single device that can function to securely house a golf ball when not in use, and to provide functionality for marking a golf ball without the drawbacks of the above noted devices.

SUMMARY OF THE INVENTION

The present invention is directed to a golf ball carrying and alignment tool. One embodiment of the device can include an elongated member having an aperture for receiving a golf ball. A removable writing instrument can be stored within the main body, and can be used to mark a line onto the golf ball via an elongated slit located in the bottom of the main body. The device can also include a hook, for securing the device onto a golf bag or other such item, and a removable lid functions to cover the aperture when no golf ball is inserted, and as a ball marker during game play.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

As described herein, the term "removably stored" and "removably secured" shall be used interchangeably to describe a situation wherein two or more objects are joined together in a non-permanent manner so as to allow the same objects to be repeatedly joined and separated.

Figure 1:
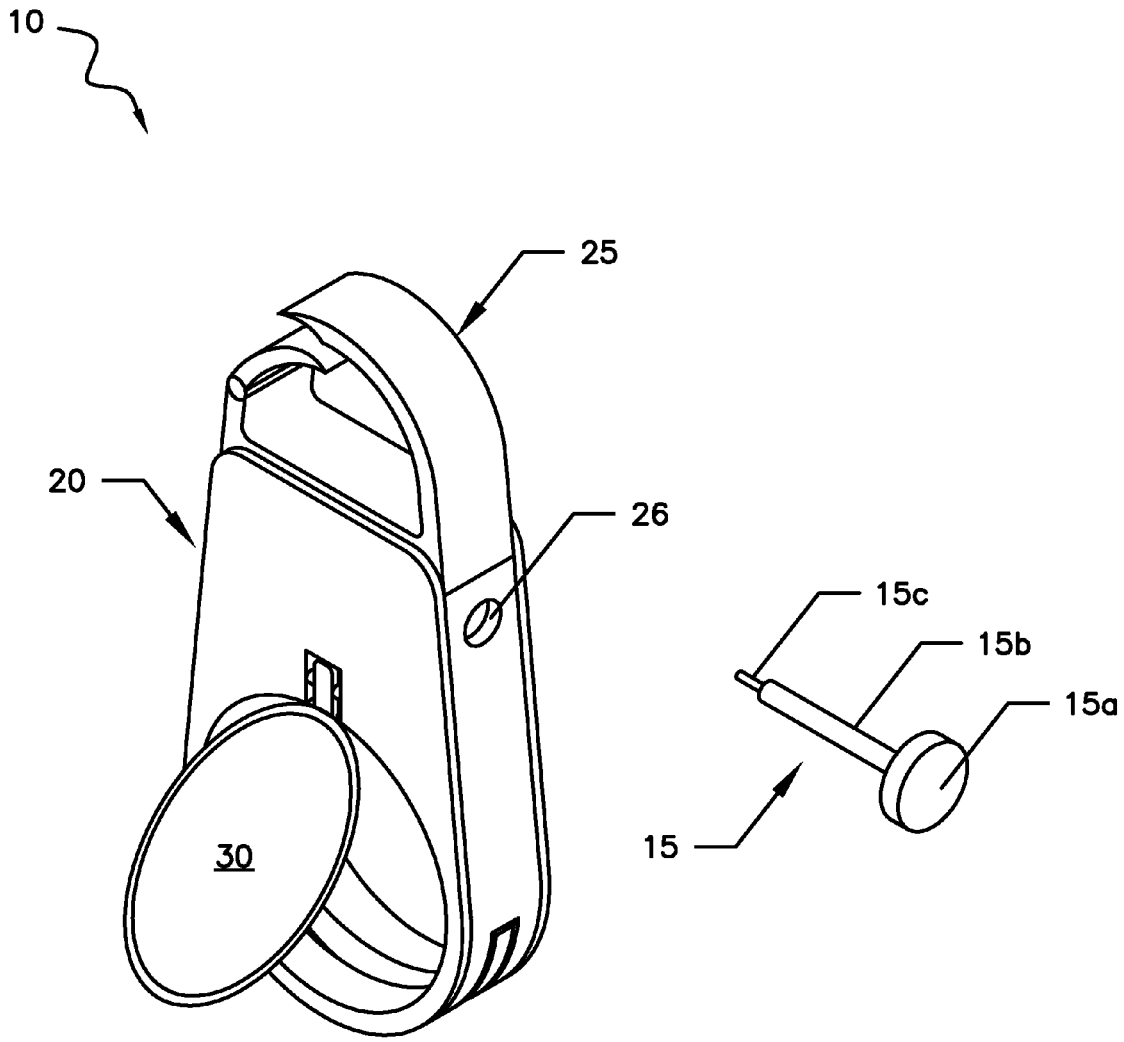
FIG. 1 is a perspective view of the golf ball carrying and alignment tool that is useful for understanding the inventive concepts disclosed herein.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

FIGS. 1-4 illustrate one embodiment of a golf ball carrying and alignment tool 10 that is useful for understanding the inventive concepts disclosed herein. As shown, the tool 10 can include, essentially, a writing instrument 15 that is removably secured to a main body 20, having a clip 25 and a ball cover 30 disposed thereon.

As described herein, the writing instrument 15 can preferably comprise a permanent ink marker having a blunt end 15*a*, a shaft portion 15*b* and a writing tip 15*c*. In the preferred embodiment, the writing instrument can include a shape that approximates a conventional golf tee; however, other shapes and writing inks are also contemplated.

Figure 2:
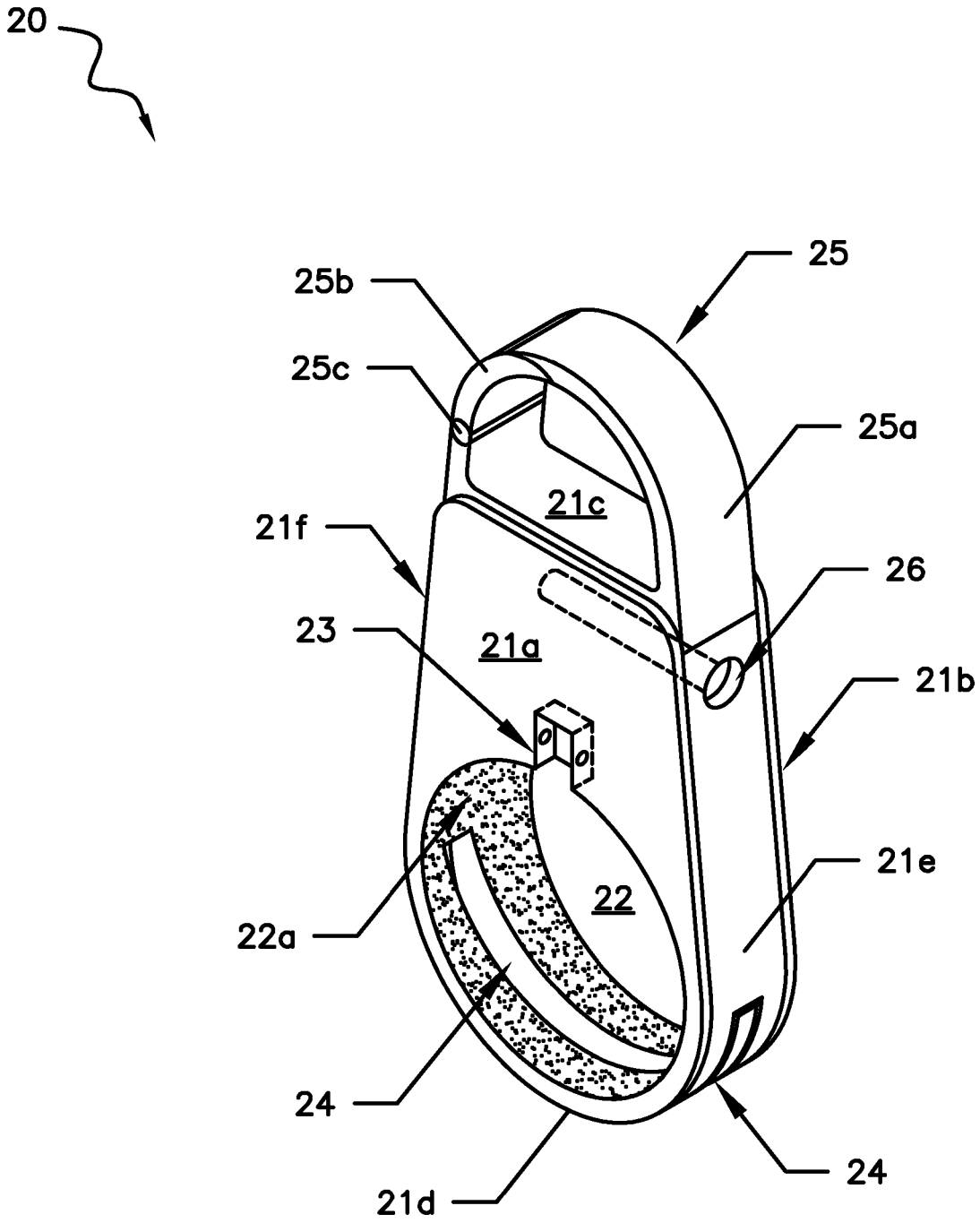
FIG. 2 is a perspective view of the main body of the golf ball carrying and alignment tool, in accordance with one embodiment of the invention.
Figure 3:
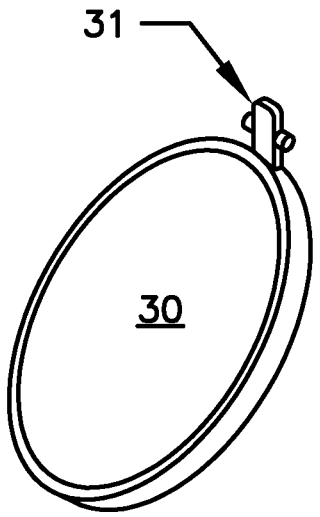
FIG. 3 is a front view of the lid portion of the golf ball carrying and alignment tool, in accordance with one embodiment of the invention.
Figure 4:
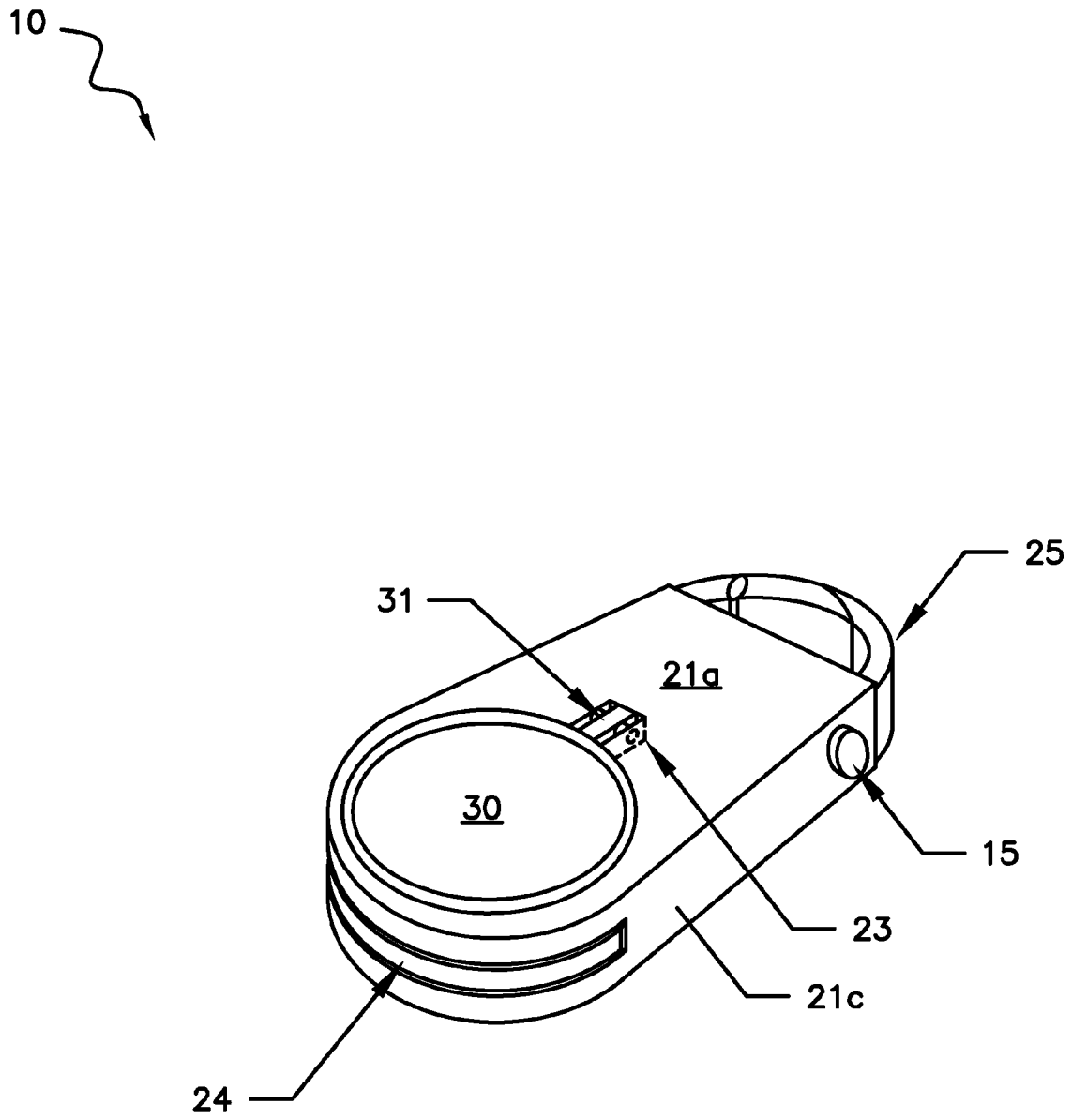
FIG. 4 is another perspective view of the golf ball carrying and alignment tool, in accordance with one embodiment of the invention.

As shown best in FIG. 2, one embodiment of the main body 20 can include an elongated and generally truncated elliptical shape, having a front surface 21*a*, a back surface 21*b*, a top end 21*c*, a bottom end 21*d*, and a pair of opposing side surfaces 21*e* and 21*f*. The main body can be constructed from any number of durable materials such as plastic, metal, PVC and the like, which are lightweight and weather resistant.

As shown, a generally circular aperture 22 can be disposed along the bottom portion of the main body that extends from the front surface 21*a* through to the back surface 21*b*. The aperture 22 including a dimension that is complementary to a conventional golf ball and functioning to receive the same through either the front surface 21*a* or the back surface 21*b*. In one embodiment, a plurality of small protrusions 22*a* can be disposed along the main body within the aperture 22. Each of these protrusions functioning to slightly reduce the diameter of the aperture, in order to allow a golf ball to be secured within the aperture without falling out.

As described herein, the protrusions 22*a* can include any number of different shapes, sizes and/or dimensions, and can include any number of different materials such as plastic or rubber, for example. In this regard, the protrusions can also be integral to the construction of the main body, or attached thereto via known manufacturing processes such as welds, glue and the like.

One or more recessed openings 23 can be disposed along the front surface of the main body 21*a*, at a location just above the aperture 22. The opening(s) 23 can function to receive the aperture cover 30 described below.

An elongated slit 24 can also be disposed along the bottom end of the main body 21*d*, and can extend along a portion of the aperture 22. As will be described below, the elongated slit 24 can include a shape and dimension suitable for allowing the writing tip of the writing instrument 15 to engage a golf ball 5 that is positioned within the aperture 22. Such a feature will allow a user to draw a straight line or other such marking onto the golf ball.

A carabiner hook 25 or other such retention device can be secured along the top portion of the main body 21*c*. As shown, the hook 25 can include a rigid hook portion 25*a*, adjoining a moveably hook portion 25*b* having a spring 25*c* or other such hardware for transitioning the hook between an open (FIG. 1) and closed (FIG. 2) orientation. The hook functioning to allow the device to be clipped onto a golf bag, belt loop or other such item when being used on a golf course.

The main body 20 also including an elongated channel 26 which can be disposed along the side wall 21*e* of the main body. The channel 26 functioning to receive and securely position the marker 15 described above.

The device 10 can also include a flat, generally circular shaped lid 30 which can be secured to the openings 23 of the main body 20 via a hinge 31 or other such component. The lid 30 functioning to pivot with respect to the main body, so as to allow insertion of a golf ball 5 within the aperture, and to cover the aperture when no golf ball is present. The lid 30 also functioning to provide a place wherein indicia such as advertisements can be displayed to device users.

In addition to the above, it is preferred that the hinge 31 and openings 23 function in a manner that allows the cover to be repeatedly connected to, and disconnected from the main body. Such a feature, along with the thin, flat profile of the cover 30 itself, which includes a thickness of approximately 1/32 inches, will allow the cover to function as a ball marker during game play.

As is known to those of skill in the game of golf, ball markers are traditionally utilized on the putting greens in order to allow golfers to mark the location of their golf ball while another golfer is putting.

Figure 5:
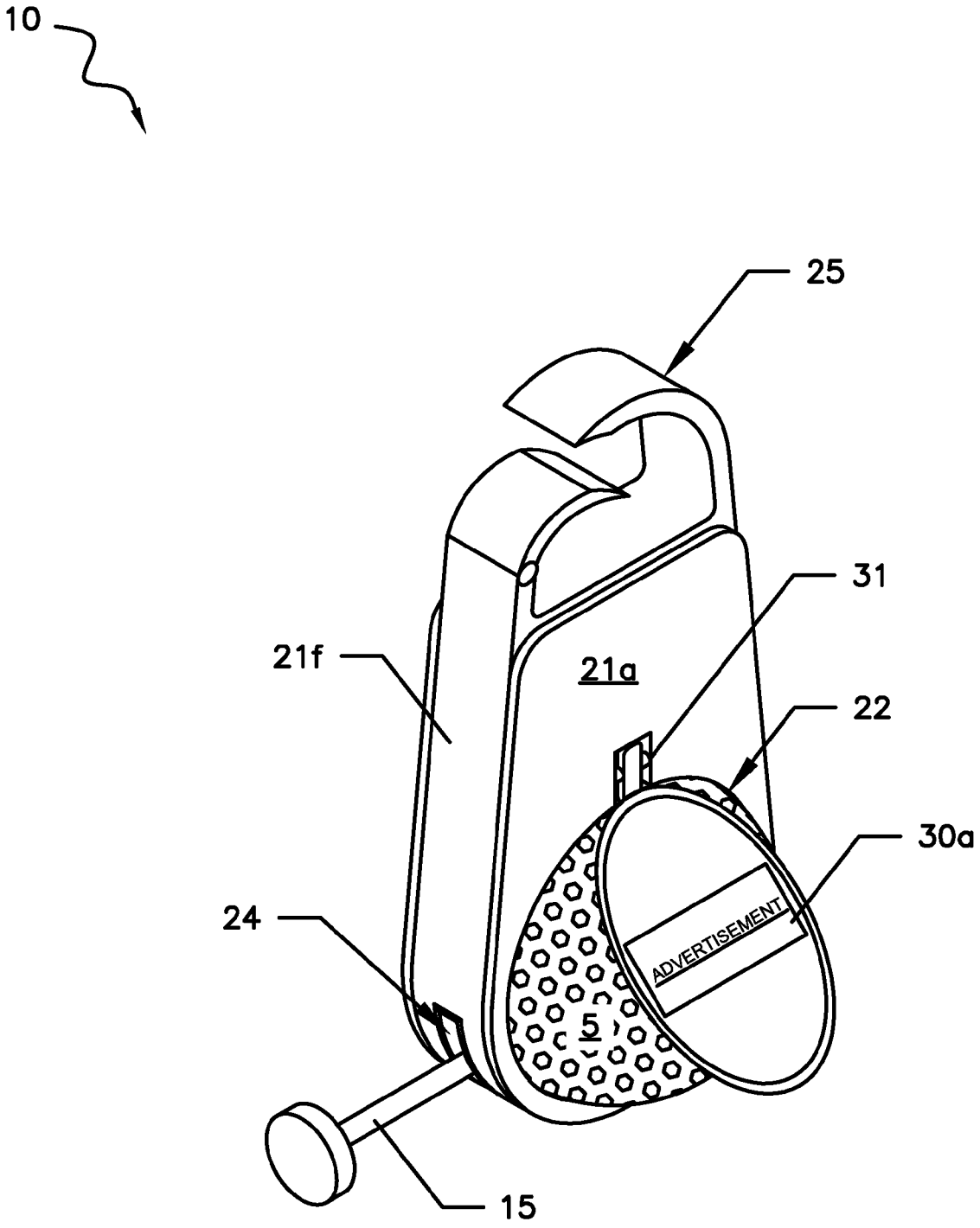
FIG. 5 is a perspective view of the golf ball carrying and alignment tool in operation, and in accordance with one embodiment of the invention.
Figure 6:
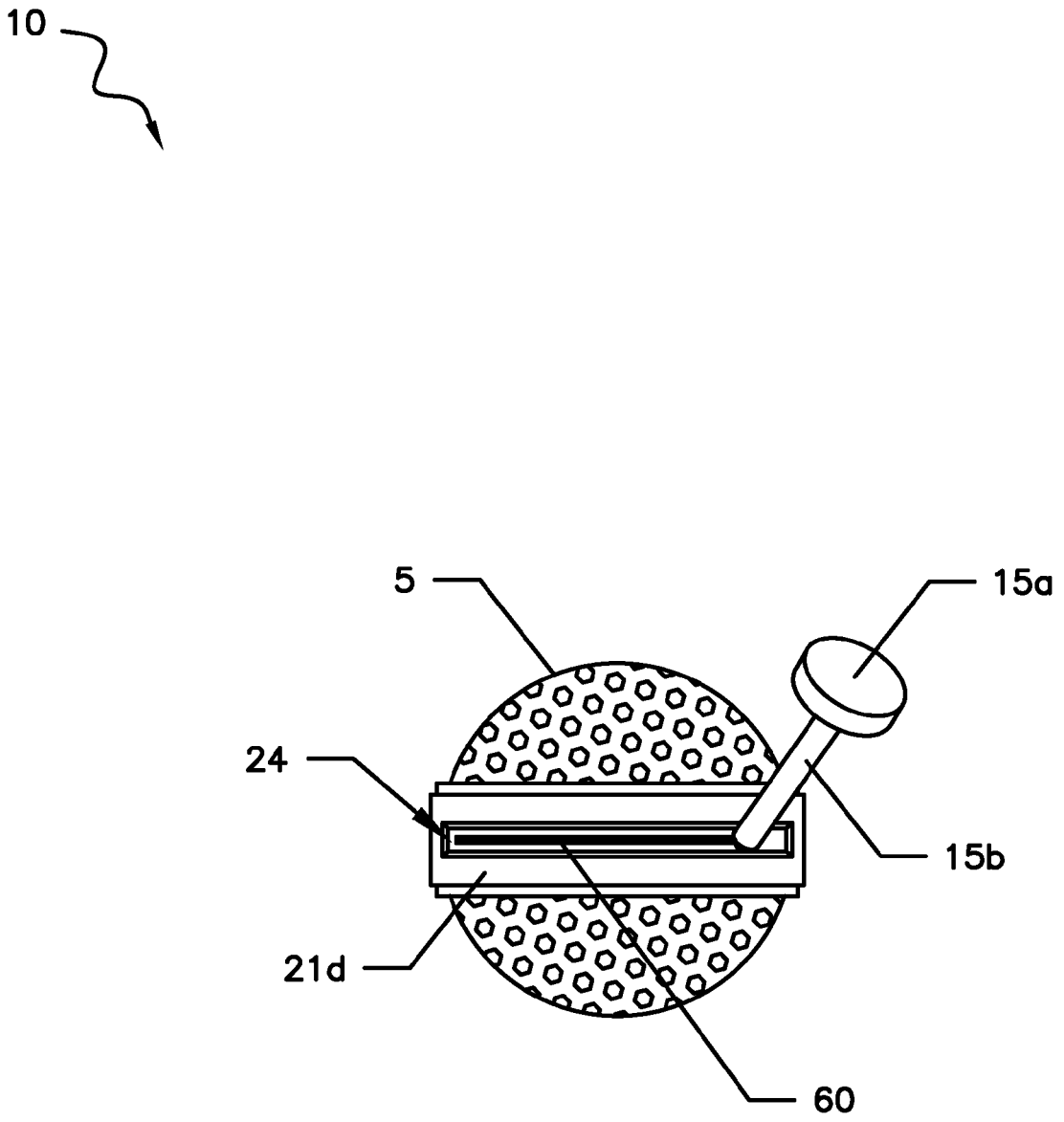
FIG. 6 is a bottom side view of the golf ball carrying and alignment tool, in accordance with one embodiment of the invention.

FIGS. 5 and 6 illustrate one embodiment of the device 10 in operation. As shown, when the golf ball 5 is inserted into the aperture 22, the lid 30 can pivot upwards, in order to display the advertisements 30*a* or other such indicia. Moreover, the writing instrument 15 can traverse the length of the elongated slit 24, in order to impart a straight line 60 onto the golf ball. In this regard, whenever the golfer removes the ball from the device 10, the line 60 can be used as a tool for aligning the putter with the golf ball and the hole.

As described herein, each element of the device can be constructed from any number of materials such as plastic, for example, which is durable and weatherproof. Additionally, one or more elements of the device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individual elements of the device may be formed together as one continuous element, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A golf ball carrying and alignment tool, said tool comprising:

a main body that includes an elongated member having a front surface, a back surface, a top end, a bottom end, and a side surface, a generally circular aperture that is disposed along the main body at a location adjacent to the bottom end, said aperture extending from the front surface of the main body to the back surface of the main body, and including a dimension that approximates a dimension of a conventional golf ball, an elongated slit that is disposed along the bottom end of the main body, said slit including a first portion that is flush with the bottom end of the main body, and a second portion that is in communication with the aperture, and an elongated channel having a first end that is disposed along the side surface of the main body;

a writing instrument that includes a blunt end, a shaft portion and a writing tip, said writing instrument including a shape and dimension that is complementary to the elongated channel, and functioning to be removably stored therein;

a generally circular shaped lid that is hingedly secured to the main body at a location above the aperture; and a hook that is disposed along the top end of the main body, said hook functioning to secure the device to a secondary object.

2. The device of claim 1, wherein the writing instrument includes a shape that approximates a conventional golf tee.

3. The device of claim 1, further comprising:

one or more protrusions that are disposed within the main body along a periphery of the aperture.

4. The device of claim 1, wherein the lid is permanently secured to the main body.

5. The device of claim 1, wherein the lid includes a generally flat construction, and is removably secured to the main body.

6. The device of claim 1, wherein the hook consists of a carabiner hook.

* * * * *